US009153862B2

(12) United States Patent
Shimizu

(10) Patent No.: US 9,153,862 B2
(45) Date of Patent: Oct. 6, 2015

(54) ANTENNA APPARATUS

(71) Applicant: Hitachi Cable, Ltd., Tokyo (JP)

(72) Inventor: Takayuki Shimizu, Hitachi (JP)

(73) Assignee: Hitachi Metals, Ltd, Tokyo (JP)

( * ) Notice: Subject to any disclaimer, the term of this patent is extended or adjusted under 35 U.S.C. 154(b) by 354 days.

(21) Appl. No.: 13/717,486

(22) Filed: Dec. 17, 2012

(65) Prior Publication Data

US 2013/0162484 A1 Jun. 27, 2013

(30) Foreign Application Priority Data

Dec. 21, 2011 (JP) ..... 2011-279779

(51) Int. Cl.
*H01Q 1/38* (2006.01)
*H01Q 1/36* (2006.01)

(52) U.S. Cl.
CPC ..... *H01Q 1/36* (2013.01)

(58) Field of Classification Search
CPC ..... H01Q 1/38; H01Q 1/24
USPC ..... 343/700 MS, 702
See application file for complete search history.

(56) References Cited

U.S. PATENT DOCUMENTS 7,532,164 B1 * 5/2009 Phillips et al. ..... 343/700 MS
7,548,207 B1 * 6/2009 Chu et al. ..... 343/700 MS
7,705,782 B2 * 4/2010 Lee ..... 343/700 MS
2002/0033770 A1 * 3/2002 Akiyama et al. ..... 343/700 MS
2004/0090389 A1 * 5/2004 Jo et al. ..... 343/797

FOREIGN PATENT DOCUMENTS

JP H 11-266120 A 9/1999
JP 2010-62979 A 3/2010

OTHER PUBLICATIONS

English Translation of Japanese Office Action dated Oct. 21, 2014.

* cited by examiner

*Primary Examiner* — Huedung Mancuso
(74) *Attorney, Agent, or Firm* — McGinn IP Law Group, PLLC

(57) ABSTRACT

An antenna apparatus includes a horizontal polarization antenna element, and the horizontal polarization antenna element includes a radiation conductor that includes two conductor plates subjected to bending work and arranged to be opposite to each other with a specific interval therebetween and has a tube shape extending in a vertical direction in whole, a ground conductor that is arranged in an inner space surrounded by the two conductor plates of the radiation conductor and is electrically grounded, and a feeding element that is arranged in the inner space, is arranged along inner walls of the conductor plates in a top view, operates as a reverse L antenna when electrical power is fed between one end thereof and the ground conductor, and feeds power to the radiation conductor by electromagnetic coupling.

9 Claims, 17 Drawing Sheets

ANTENNA APPARATUS

The present application is based on Japanese patent application No. 2011-279779 filed on Dec. 21, 2011, the entire contents of which are incorporated herein by reference.

BACKGROUND OF THE INVENTION

1. Field of the Invention

The present invention relates to an antenna apparatus.

2. Description of Related Art

In a base station of mobile communication such as a cellular phone or a PHS (Personal Handyphone System), since a service area is formed on a concentric circle whose center is the base station, an antenna apparatus with uniform directivity in the horizontal plane is used.

In general, in the antenna apparatus for the base station, it is desired that the antenna apparatus is made small in diameter and a construction for installing the antenna apparatus is made simple. An antenna element is desired which has a compact structure and enables the antenna apparatus to be made small in diameter.

A horizontal polarization antenna element (horizontal polarization omni element) shown in FIG. 20A and FIG. 20B is known to be used for an antenna apparatus (horizontal polarization omni antenna) in which the directivity of horizontal polarization in the horizontal plane is uniform.

In a horizontal polarization antenna element 200 shown in FIG. 20A, an arm portion (conductor portion) of a dipole antenna 201 horizontal to the ground is bent to form a compact structure.

A horizontal polarization antenna element 202 shown in FIG. 20B has a structure in which a patch antenna 203 bent in a rectangular shape is surrounded by parasitic elements 204. In the horizontal polarization antenna element 202, an electric wave radiated by the patch antenna 203 is shaped by the parasitic elements 204 and the directivity in the horizontal plane is uniformed.

When the horizontal polarization antenna element as shown in FIG. 20A or 20B and a vertical polarization antenna element having uniform directivity in the horizontal plane are arranged side by side and are disposed in an array shape, a polarization diversity omnidirectional antenna can be achieved.

An example of the related art includes JP-A-2010-62979.

SUMMARY OF THE INVENTION

In the horizontal polarization antenna element 200 of FIG. 20A using the dipole antenna 201, electrical power is required to be fed through a balun (balance-to-unbalance transformer) in order to perform appropriate power feeding, and there is a problem that the structure of the antenna apparatus becomes complicated.

In the horizontal polarization antenna element 202 of FIG. 20B, since the patch antenna 203 is used, a balun can be omitted, and the small antenna apparatus with the simple structure can be achieved.

The inventor studied to realize a horizontal polarization antenna element which operates in a principle different from the horizontal polarization antenna element 202 of the related art, has more uniform directivity in the horizontal plane, and has a small and simple structure comparable to that of the related art, and as a result, the present invention was achieved.

The invention is made in view of the above circumstances, and has an object to provide an antenna apparatus which has uniform directivity in a horizontal plane and has a simple structure.

According to an aspect of the exemplary invention, an antenna apparatus includes a horizontal polarization antenna element, and the horizontal polarization antenna element includes a radiation conductor including two conductor plates subjected to bending work and arranged to be opposite to each other with a specific interval therebetween, the radiation conductor having a tube shape extending in a vertical direction in whole, a ground conductor arranged in an inner space surrounded by the two conductor plates of the radiation conductor, the ground conductor being electrically grounded, and a feeding element arranged in the inner space to be along inner walls of the conductor plates in a top view, the feeding element operating as a reverse L antenna when electrical power is fed between one end thereof and the ground conductor, and feeding power to the radiation conductor by electromagnetic coupling.

In the above exemplary invention, many exemplary modifications and changes can be made as below.

(i) The ground conductor has a tube shape extending in the vertical direction and is arranged at a center of the inner space in a top view, and the feeding element is arranged in the inner space between the conductor plate and the ground conductor.

(ii) Each of the two conductor plates has a U shape in a top view, and openings of the conductor plates are arranged opposite to each other.

(iii) The horizontal polarization antenna element further includes a horizontal board arranged on a horizontal plane and two vertical boards arranged to be opposite to each other across the horizontal board and to extend in the vertical direction while front surfaces are directed outward, one of the conductor plates includes conductor patterns formed on front surface sides and at one side ends of both the vertical boards and a metal plate that is electrically connected to both the conductor patterns and is provided to extend between the one side ends of both the vertical boards, the other of the conductor plates includes conductor patterns formed on rear surface sides and at the other side ends of both the vertical boards and a metal plate that is electrically connected to both the conductor patterns and is provided to extend between the other side ends of both the vertical boards, and the feeding element includes a conductor pattern formed on the horizontal board.

(iv) The horizontal polarization antenna element further includes a horizontal board arranged on a horizontal plane and two vertical boards arranged to be opposite to each other across the horizontal board and to extend in the vertical direction while front surfaces are directed outward, one of the conductor plates includes conductor patterns formed on front surface sides and at one side ends of both the vertical boards and a metal plate that is electrically connected to both the conductor patterns and is provided to extend between the one side ends of both the vertical boards, the other of the conductor plates includes conductor patterns formed on the front surface sides and at the other side ends of both the vertical boards and a metal plate that is electrically connected to both the conductor patterns and is provided to extend between the other side ends of both the vertical boards, and the feeding element includes a conductor pattern formed on the horizontal board.

(v) The horizontal board has a concave shape in a top view, the horizontal polarization antenna element further includes a ground board that is provided to close an opening of the horizontal board and extends in the vertical direction while a front surface is directed outward, the ground conductor includes a ground conductor pattern formed on a rear surface of the ground board, a ground metal plate contained in a concave-shaped cut-away part of the horizontal board and having a U shape with an opening directed to the ground board side in a top view, and the ground conductor pattern and the ground metal plate provide a gap between both ends of the ground conductor pattern and both ends of the ground metal plate.

(vi) Side ends of the two conductor plates in a horizontal direction overlap each other.

(vii) Each of the two conductors has an arc shape in a top view, and the openings of the conductor plates are arranged opposite to each other.

(viii) The horizontal polarization antenna element is arrayed in the vertical direction.

(ix) The horizontal polarization antenna elements are provided in which an arrangement of the feeding element and the ground conductor is same, and the radiation conductor is relatively rotated by 90° in a top view, and the horizontal polarization antenna elements are alternately arranged.

(x) The antenna apparatus further includes a vertical polarization antenna element, and the vertical polarization antenna element and the horizontal polarization antenna element are arrayed in the vertical direction.

According to the exemplary embodiments of the invention, the antenna apparatus having uniform directivity in the horizontal plane and the simple structure can be provided.

BRIEF DESCRIPTION OF THE DRAWINGS

The foregoing and other exemplary purposes, aspects and advantages will be better understood from the following detailed description of the invention with reference to the drawings, in which.

DETAILED DESCRIPTION OF THE INVENTION

Hereinafter, exemplary embodiments of the invention will be described with reference to the accompanying drawings.

An antenna apparatus of the invention is an antenna apparatus (horizontal polarization omni antenna) including a horizontal polarization antenna element (horizontal polarization omni element) having uniform directivity in a horizontal plane, and is used as, for embodiment, an antenna apparatus for a base station of mobile communication.

Horizontal Polarization Antenna Element

First, a horizontal polarization antenna element used in an antenna apparatus of the invention will be described in detail.

Figure 1A:
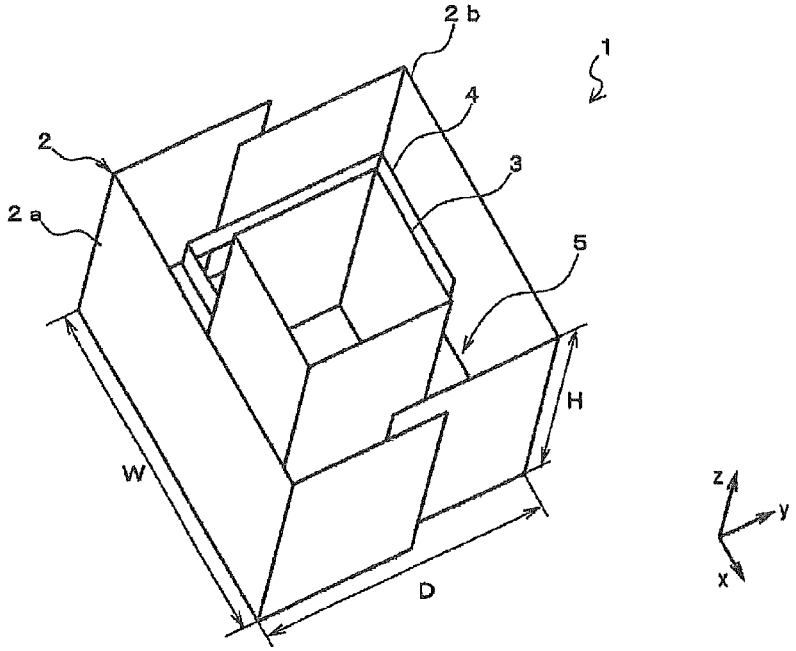
FIG. 1A is a perspective view showing a horizontal polarization antenna element used in an antenna apparatus of an embodiment of the invention.
Figure 1B:
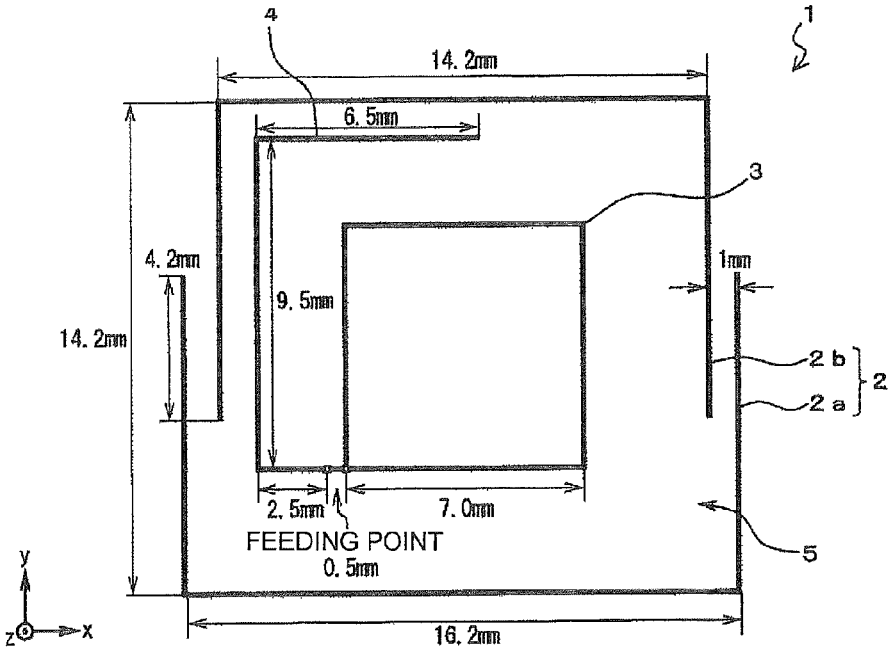
FIG. 1B is a top view showing the horizontal polarization antenna element.

As shown in FIGS. 1A and 1B, a horizontal polarization antenna element 1 used in an antenna apparatus of the invention mainly includes a radiation conductor 2, a ground conductor 3 and a feeding element 4.

The radiation conductor 2 includes two conductor plates 2*a* and 2*b* subjected to bending work and arranged to be opposite to each other with a specific interval therebetween, and is formed in a tube shape extending in the vertical direction in whole. Here, a rectangular metal plate (e.g. copper plate) is used as the conductor plate 2*a*, 2*b*. The two rectangular conductor plates 2*a* and 2*b* are formed in a U shape in a top view by bending the conductor plates 2*a* and 2*b* to one surface side so that fold lines become parallel to one side of the conductor plates 2*a* and 2*b*, and are arranged so that opening parts thereof are opposite to each other. The radiation conductor 2 is consequently formed in a rectangular tube shape extending in the vertical direction in whole. In addition, the conductor plates 2*a* and 2*b* are out of contact with each other with the specific interval therebetween.

Besides, in the horizontal polarization antenna element 1, the one conductor plate 2*a* is formed to have the width (length in an x-axis direction) longer than the width of the other conductor plate 2*b*. The two conductor plates 2*a* and 2*b* are overlapped and arranged so that side ends thereof in the horizontal direction overlap each other (the conductor plate 2*b* enters the inside of the conductor plate 2*a*).

The ground conductor 3 is arranged in an inner space 5 surrounded by the two conductor plates 2*a* and 2*b* of the radiation conductor 2, and is electrically grounded. Here, the ground conductor 3 is formed in a rectangular tube shape extending in the vertical direction, and is arranged at the center of the inner space 5 in a top view.

The feeding element 4 is arranged in the inner space 5, and is arranged along inner walls of the conductor plates 2*a* and 2*b* in a top view. The feeding element 4 includes a linear conductor, operates as a reverse L antenna when electrical power is fed between one end thereof and the ground conductor 3, and performs reverse L antenna feeding to feed power to the radiation conductor 2 by electromagnetic coupling.

Here, the reverse L antenna (reverse L-type antenna) is a modification of a monopole antenna called also an L-probe, and the reverse L antenna feeding is called also L-probe feeding. Incidentally, the reverse L antenna is not limited to the reverse L shape, and generally indicates a radiation conductor which has a component parallel to a ground conductor and uses a capacitance component formed between itself and the ground conductor.

That is, in the horizontal polarization antenna element 1, electric power is fed to the feeding element 4 operating as the reverse L antenna, so that electric power is fed to the radiation conductor 2 including the two conductor plates 2*a* and 2*b* by the reverse L antenna feeding, and the radiation conductor 2 is excited and generates a horizontally polarized wave at a desired frequency.

If the circumferential length (W+D)×2 of the radiation conductor 2 in a top view is made long, the band is widened, however, the deviation of directivity in the horizontal plane becomes large and the element becomes large. On the contrary, if the length is made short, the deviation of directivity in the horizontal plane becomes small, and the element becomes small, however, the band becomes narrow. Thus, an appropriate length is selected in view of their balance. Specifically, the length is preferably 0.5 to 0.6λ, in which the bandwidth, the deviation of directivity in the horizontal plane and the size of the element are well balanced. Besides, height H of the radiation conductor 2 (conductor plate 2*a*, 2*b*) is made λ/8. Although the length of one side of the ground conductor 3 is not regulated, when a board is used as described later (see, for example, FIGS. 3A to 3C), the length is preferably made 8 mm or more in view of formation of a feeding line (described later) of 50Ω for feeding electrical power to the feeding element 4. Incidentally, λ denotes a wavelength corresponding to a center frequency $f_0$ of an electric wave to be transmitted and received.

In the horizontal polarization antenna element 1, the center frequency $f_0$ of the electric wave to be transmitted and received can be adjusted by the overlap length of both the conductor plates 2*a* and 2*b*. The center frequency $f_0$ is generally expressed by the following expression.

$$f_0=1/(2\pi(L\cdot C)^{1/2})$$

For example, if the overlap length becomes large, the capacitive component C between both the conductor plates 2*a* 2*b* becomes large, and the center frequency $f_0$ becomes small.

Besides, in the horizontal polarization antenna element 1, impedance matching between the feeding line connected to the feeding element 4 and the radiation conductor 2 can be performed by the length of the feeding element 4. As the feeding element 4 becomes short, coupling to the periphery becomes weak, while as the feeding element becomes long, the coupling becomes strong. That is, the feeding element 4 serves as impedance matching between the feeding line and the radiation conductor 2.

Figure 2:
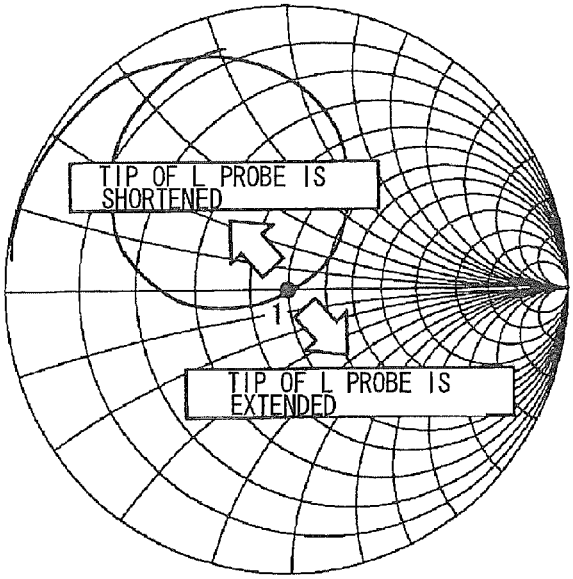
FIG. 2 illustrates a Smith chart used when impedance is matched in the horizontal polarization antenna element of FIG. 1A and FIG. 1B.

In the horizontal polarization antenna element 1, when the center frequency $f_0$ is adjusted, a Smith chart (impedance chart) as shown in FIG. 2 is used. The length of the feeding element 4 is determined so that the locus on the Smith chart is positioned at the center position (position where the normalized impedance is 1Ω), and then, the overlap length of both the conductor plates 2*a* and 2*b* is determined, and the center frequency $f_0$ can be easily adjusted. Incidentally, the adjustment of the center frequency $f_0$ is not required to be performed many times, and if the length of the feeding element 4 and the overlap length of both the conductor plates 2*a* and 2*b* are once determined, the adjustment at the time of mass production or the like is not required. As an example, sizes of respective parts when the center frequency $f_0$ is 2610 MHz are shown in FIG. 1B.

Next, a horizontal polarization antenna element of another embodiment will be described.

Figure 3A:
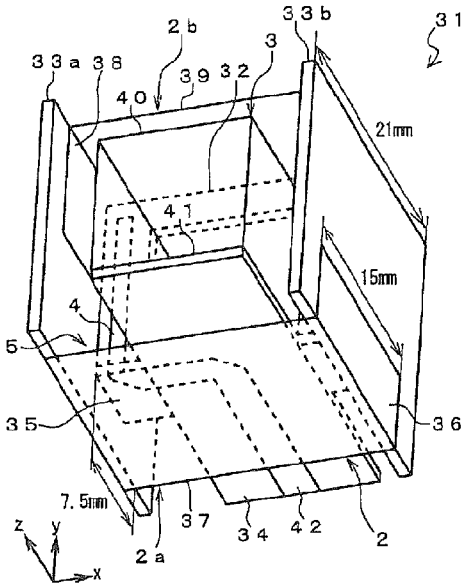
FIG. 3A is a perspective view showing a horizontal polarization antenna element of another embodiment.
Figure 3B:
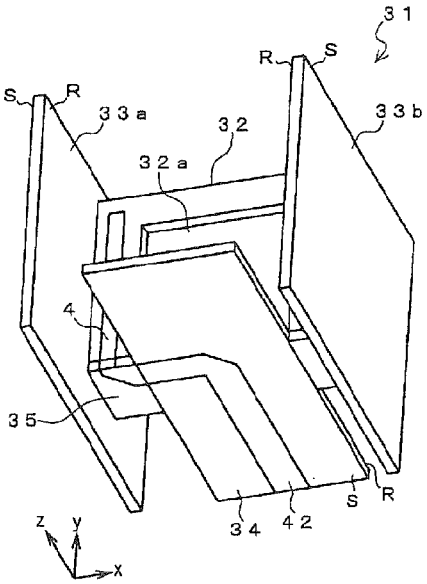
FIG. 3B is a perspective view in which a radiation conductor and a ground conductor are omitted.
Figure 3C:
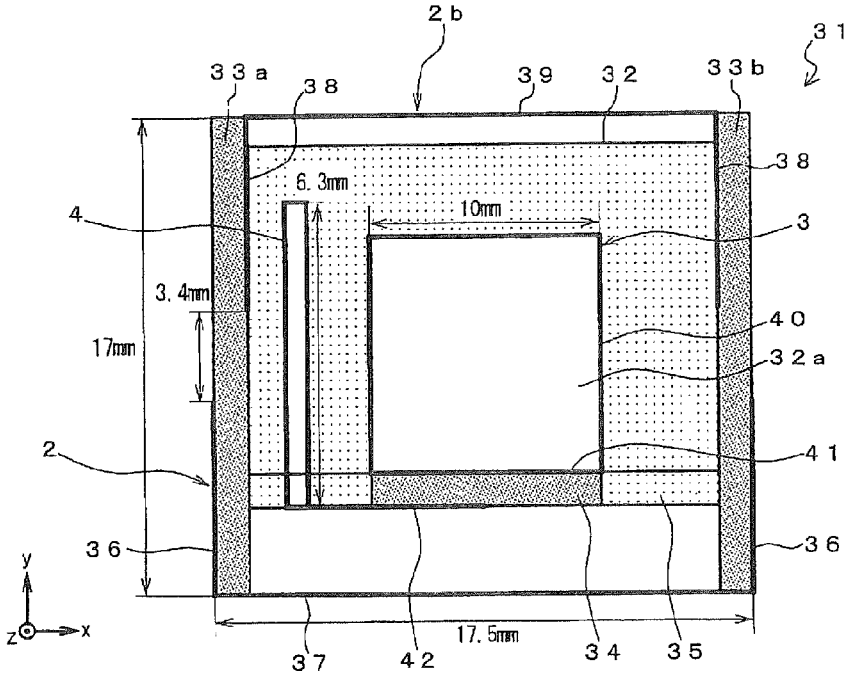
FIG. 3C is a top view of the horizontal polarization antenna element.

Although a horizontal polarization antenna element 31 shown in FIGS. 3A to 3C has basically the same structure as the horizontal polarization antenna element 1 of FIGS. 1A and 1B, there is a difference that a board is used.

In the foregoing horizontal polarization antenna element 1, although the respective conductors are arranged in the air, a structure to support the respective conductors is actually required. In the horizontal polarization antenna element 31 of FIGS. 3A to 3C, as the support structure, four boards 32, 33*a*, 33*b* and 34 are combined and used.

That is, the horizontal polarization antenna element 31 includes the one horizontal board 32, the two vertical boards 33*a* and 33*b* and the ground board 34 in addition to the horizontal polarization antenna element 1 of FIGS. 1A and 1B.

In this embodiment, as the respective boards 32, 33*a*, 33*b* and 34, a dielectric board (Teflon board, Teflon thickness is 0.73 mm, Cu (conductor pattern) thickness is 35 μm, Teflon is a registered trademark) having a thickness of 0.8 mm and a relative dielectric constant of 2.6 was used. As the horizontal board 32, a one-sided board in which a conductor pattern can be formed only on one side can be used. As the vertical boards 33*a* and 33*b* and the ground board 34, a double-sided board in which a conductor pattern can be formed on both sides is required to be used.

The horizontal board 32 is arranged on the horizontal plane (XY plane). The two vertical boards 33*a* 33*b* are arranged to be opposite to each other across the horizontal board 32, and are arranged to extend in the vertical direction while a front surface S is directed outside (opposite side to the horizontal board 32). Here, the vertical boards 33*a* and 33*b* were arranged on the YZ plane, and the vertical boards 33*a* and 33*b* were arranged so as to sandwich the horizontal board 32 from both sides in the X-axis direction. The horizontal board 32 and the vertical boards 33*a* and 33*b* are bonded and fixed, and are formed in an H shape in whole in a side view.

Besides, the horizontal board 32 is formed in a concave shape in a top view, and a notch 32*a* is formed which has a rectangular shape in a top view and is opened in a direction (y-axis direction, lower side in FIG. 3C) in which the vertical boards 33*a* and 33*b* are not fixed. The ground board 34 is formed to have the same width as the width of the opening part of the notch 32*a*, and is provided to extend in the vertical direction and to close the opening part of the notch 32*a* while the front surface S is directed outside (opposite side to the horizontal board 32). Here, the ground board 34 was arranged on the XZ plane.

The ground board 34 is integrally provided with fixing members 35 for fixing the ground board 34 to the horizontal board 32. The fixing members 35 are provided to protrude outside in the width direction (X-axis direction) from both sides of the center of the ground board 34 in the vertical direction (Z-axis direction), and the ground board 34 provided with the fixing members 35 is formed in a cross shape in whole in a side view. The fixing members 35 are bonded and fixed to the side surface of the horizontal board 32 in a state where the upper end thereof is coincident with the upper surface of the horizontal board 32, and by this, the ground board 34 is fixed to the horizontal board 32.

The width (length in the X-axis direction) from an end of the one fixing member 35 to an end of the other fixing member 35 is formed to be equal to the width of the horizontal board 32, and the ends of the fixing members 35 are bonded and fixed to both the vertical boards 33*a* and 33*b*. By the formation as stated above, the fixing members 35 not only serve to fix the ground board 34 to the horizontal board 32, but also serve to enhance the mechanical strength of the structure in which the boards 32, 33*a*, 33*b* and 34 are combined.

In the horizontal polarization antenna element 31, one conductor plate 2*a* includes conductor patterns 36 formed on one side ends (lower side in FIG. 3C) at the front surface S side of both the vertical boards 33*a* and 33*b*, and a metal plate 37 electrically connected to both the conductor patterns 36 and provided to extend between the one side ends of both the vertical boards 33*a* and 33*b*. The other conductor plate 2*b* includes conductor patterns 38 formed on the other side ends (upper side in FIG. 3C) at the rear surface R side of both the vertical boards 33*a* and 33*b*, and a metal plate 39 electrically connected to both the conductor patterns 38 and provided to extend between the other side ends of both the vertical boards 33*a* and 33*b*. The metal plates 37 and 39 are fixed to the conductor patterns 36 and 38 by soldering and are electrically connected.

Incidentally, in the horizontal polarization antenna element 1 of FIGS. 1A and 1B, since the air exists between both the conductor plates 2*a* and 2*b*, the side ends of both the conductor plates 2*a* and 2*b* are overlapped each other in order to ensure electrostatic capacity between both the conductor plates 2*a* 2*b*. In the horizontal polarization antenna element 31 of FIGS. 3A to 3C, since the dielectric board (vertical board 33*a*, 33*b*) having a relative dielectric constant of 2.6 is inserted between both the conductor plates 2*a* and 2*b*, the electrostatic capacity between both the conductor plates 2*a* and 2*b* is 2.6 times larger than that of the horizontal polarization antenna element 1 of FIGS. 1A and 1B. Thus, in the horizontal polarization antenna element 31, both the conductor plates 2*a* and 2*b* are not overlapped each other, and are arranged to be separated from each other in the Y-axis direction, so that the electrostatic capacity between both the conductor plates 2*a* and 2*b* is adjusted, and the center frequency $f_0$ is adjusted.

Besides, in the horizontal polarization antenna element 31, a ground conductor 3 includes a ground metal plate 40 which is contained in the cut-away part (notch 32*a*) of the concave-shaped horizontal board 32, is formed in a U shape in a top view, and arranged so that the opening part thereof is directed to the ground board 34 side, and a ground conductor pattern 41 formed on the rear surface R of the ground board 34. The ground metal plate 40 is fixed to the ground conductor pattern 41 by soldering, and is electrically connected.

The ground conductor patter 41 is formed on the whole surface of the rear surface R of the ground board 34, and a feeding line 42 of 50Ω for feeding power to a feeding element 4 is formed of a conductor pattern on the front surface S.

A conductor pattern which becomes the feeding element 4 is formed on the upper surface of the horizontal board 32. The feeding element 4 is desirably formed at the center of a radiation conductor 2 in the vertical direction, and the horizontal board 32 is fixed to both the vertical boards 33*a* 33*b* so that the upper surface thereof is positioned at the center of the radiation conductor 2 in the vertical direction. Incidentally, in order to connect the feeding element 4 formed on the horizontal board 32 and the feeding line 42 formed on the ground board 34, a conductor pattern passing through the fixing member 35 and connecting both is formed. The conductor pattern formed on the fixing member 35 is also treated as a part of the feeding element 4. Incidentally, the conductor pattern of the fixing member 35 is formed only on the front surface S side of the ground board 34, and a portion between the conductor pattern of the fixing member 35 and the conductor pattern of the horizontal board 32 (a portion of the side surface of the fixing member 35) may be electrically connected by, for example, soldering a tin-plated wire.

Incidentally, in the horizontal polarization antenna element 31, although the feeding element 4 is not directly connected to the ground conductor 3, the base end of the feeding element 4 (end, on the ground board 34 side, of the conductor pattern formed on the fixing member 35) is capacitance-coupled to the ground conductor 3 (ground conductor pattern 41) through the ground board 34, and electrical power is fed to the base end of the feeding element 4 by the feeding line 42.

Figure 4A:
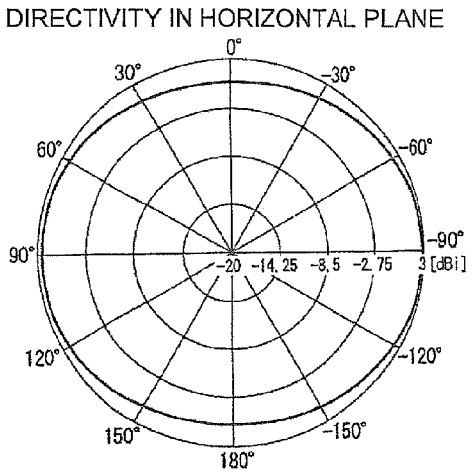
FIG. 4A illustrates a characteristic of directivity in the horizontal plane of the horizontal polarization antenna element of FIG. 3A to FIG. 3C.
Figure 4B:
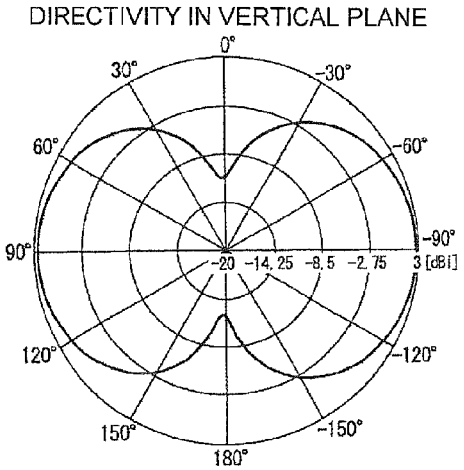
FIG. 4B illustrates a characteristic of directivity in the vertical plane.
Figure 4C:
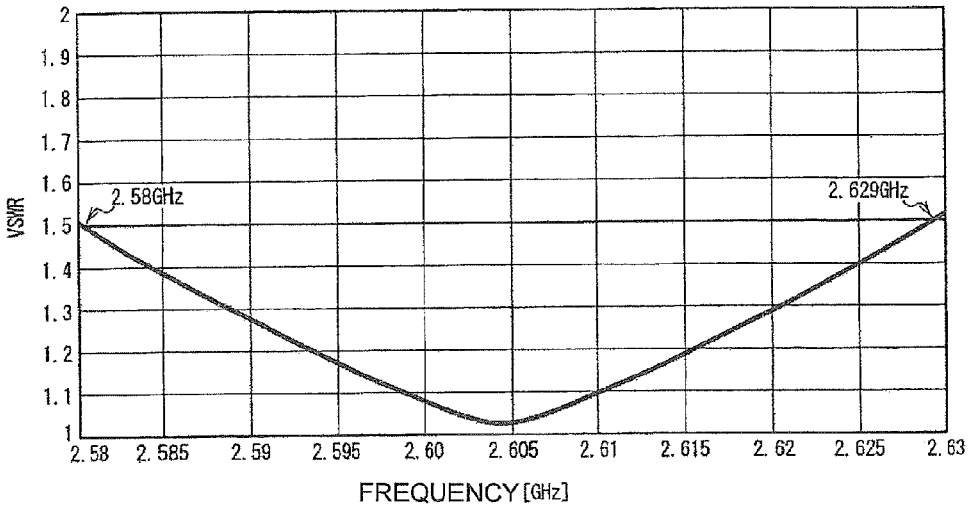
FIG. 4C illustrates a VSWR characteristic.

Sizes of respective parts when the center frequency $f_0$ is 2610 MHz are shown in FIGS. 3A and 3C. Incidentally, in FIG. 3C, although the width of the feeding element 4 is omitted, the width of the feeding element 4 is 1 mm, and the width of the feeding line 42 is 2 mm. FIGS. 4A to 4C show a directivity in the horizontal plane, a directivity in the vertical plane, and a VSWR (Voltage Standing Wave Ratio) characteristic when the horizontal polarization antenna element 31 with the sizes of FIGS. 3A and 3C is formed.

As shown in FIG. 4A, the directivity in the horizontal plane of the horizontal polarization antenna element 31 was substantially uniform, and the deviation thereof was 2.69 dB (maximum 2.98 dBi, minimum 0.29 dBi). Besides, as shown in FIG. 4C, the bandwidth in which the VSWR is 1.5 or less is 49 MHz and is 1.9% in a relative bandwidth, and it is understood that the sufficient band can be achieved. In an omni antenna, the deviation of the directivity in the horizontal plane is required to be less than 3 dB, and the practical bandwidth is required to be 30 MHz or more. It is understood that the horizontal polarization antenna element 31 satisfying both the conditions can be achieved.

Figure 5A:
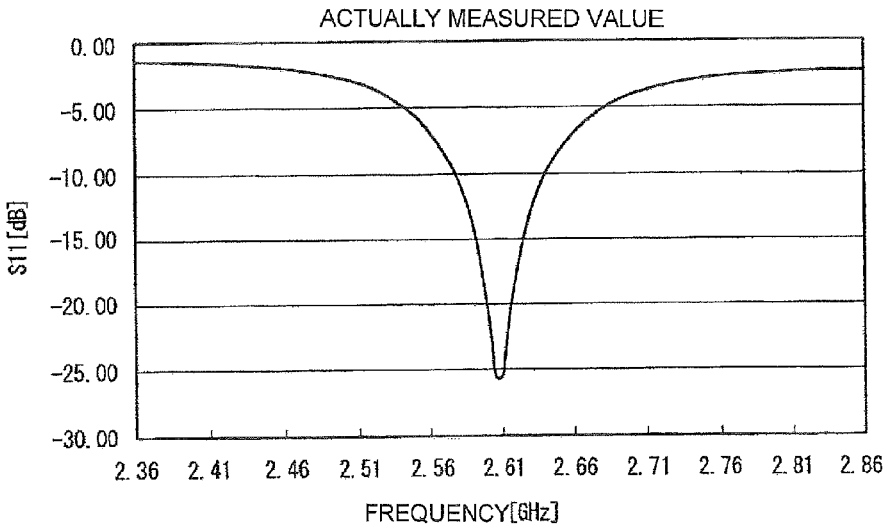
FIG. 5A illustrates an S11 characteristic of the horizontal polarization antenna element of FIG. 3A to FIG. 3C and an actually measured value.
Figure 5B:
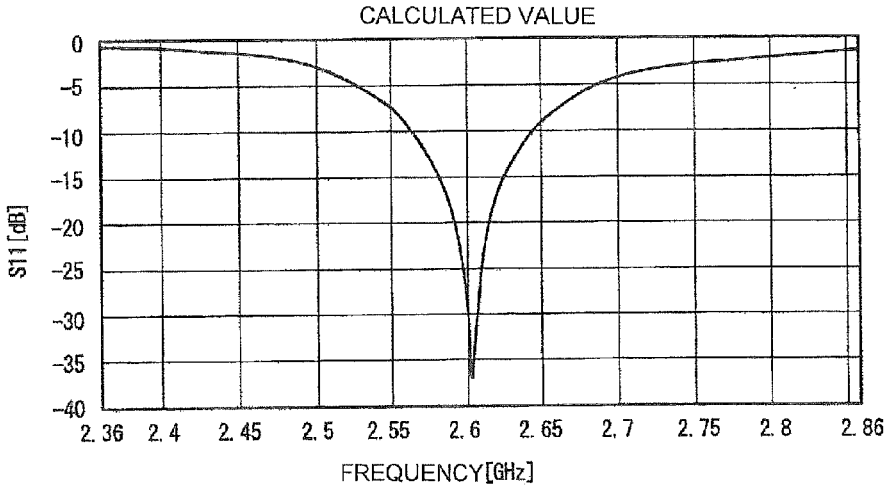
FIG. 5B illustrates a calculated value.

FIGS. 5A and 5B show an actually measured value and a calculated value of S11 characteristic of the horizontal polarization antenna element 31. As is understood from the comparison between FIGS. 5A and 5B, the actually measured value and the calculated value are well coincident with each other, and it is understood that the characteristic as calculated is obtained.

Figure 6A:
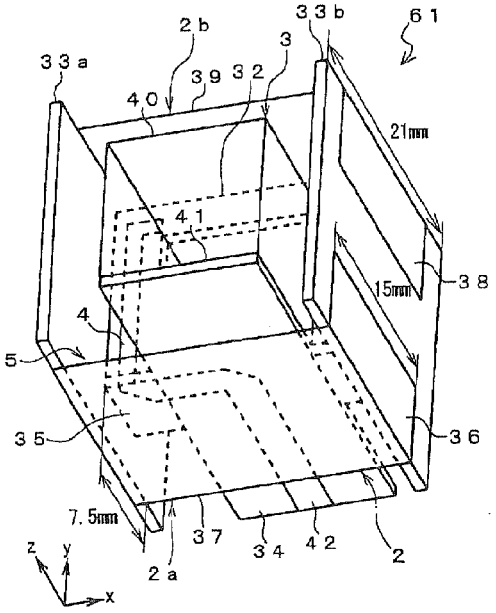
FIG. 6A is a perspective view showing a horizontal polarization antenna element of another embodiment of the invention.
Figure 6B:
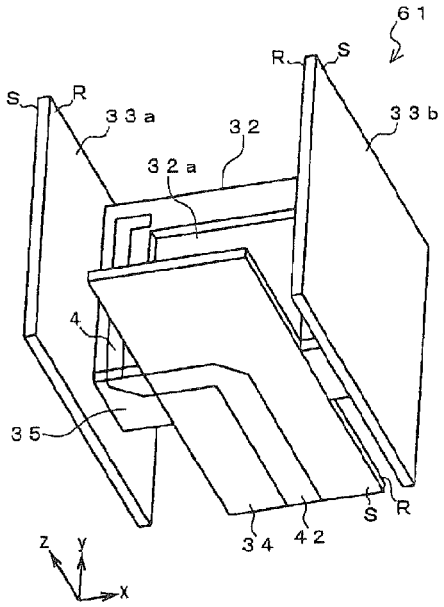
FIG. 6B is a perspective view in which a radiation conductor and a ground conductor are omitted.
Figure 6C:
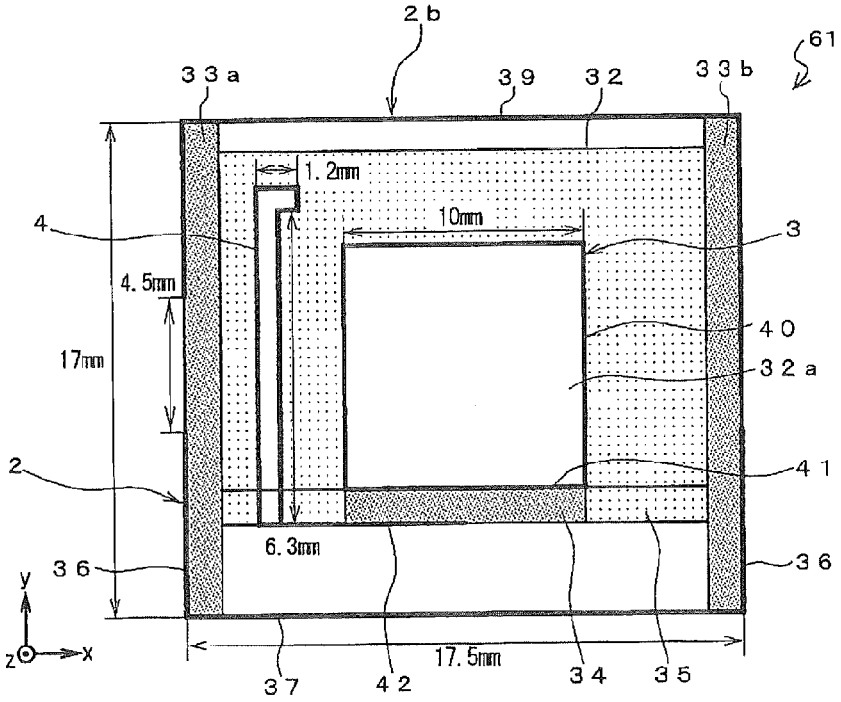
FIG. 6C is a top view of the horizontal polarization antenna element.

A horizontal polarization antenna element 61 shown in FIGS. 6A to 6C is such that in the horizontal polarization antenna element 31 of FIGS. 3A to 3C, the conductor pattern 38 constituting the conductor plate 2*b* is formed on the surface S side of both the vertical boards 33*a* and 33*b*. In the horizontal polarization antenna element 61, two conductor plates 2*a* and 2*b* have the same shape. In the horizontal polarization antenna element 61, a one-sided board can be used as the vertical board 33*a*, 33*b*, and the same boards can be used for both the vertical boards 33*a* and 33*b*. Accordingly, the cost can be reduced as compared with the horizontal polarization antenna element 31.

Sizes of respective parts when the center frequency $f_0$ is 2610 MHz are shown in FIGS. 6A and 6C. Since the conductor pattern 38 is formed on the surface S side of the vertical boards 33*a* and 33*b*, a coupling state to the periphery of a feeding element 4 is changed. Thus, in the horizontal polarization antenna element 61, in order to match the impedance and to adjust the center frequency $f_0$, the length of the feeding element 4 and the interval between both the conductor plates 2*a* and 2*b* are changed as compared with the horizontal polarization antenna element 31 of FIGS. 3A to 3C.

Figure 7A:
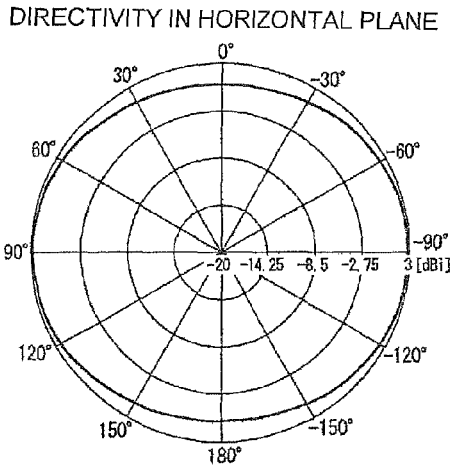
FIG. 7A illustrates a characteristic of directivity in the horizontal plane of the horizontal polarization antenna element of FIG. 6A to FIG. 6C.
Figure 7B:
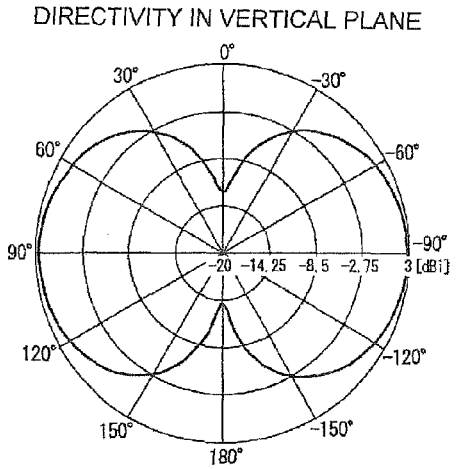
FIG. 7B illustrates a characteristic of directivity in the vertical plane.
Figure 7C:
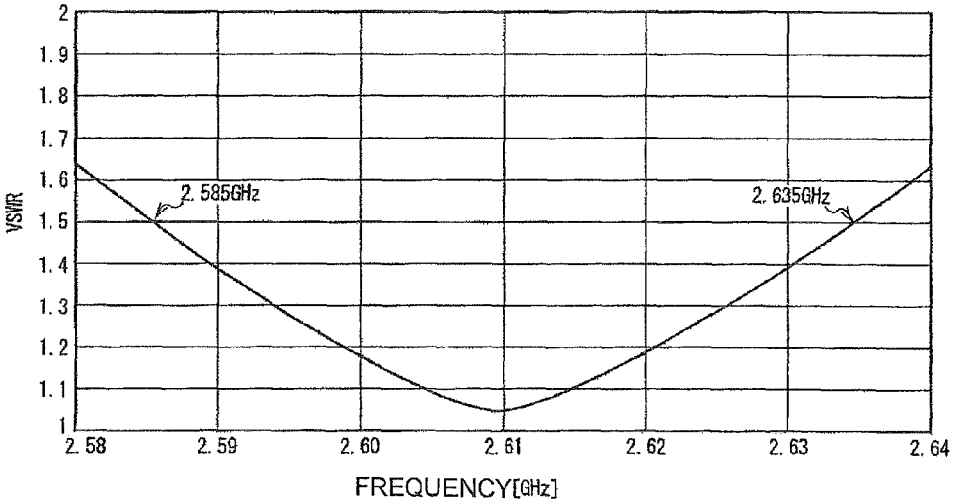
FIG. 7C illustrates a VSWR characteristic.

FIGS. 7A to 7C show a directivity in the horizontal plane, a directivity in the vertical plane, and a VSWR characteristic when the horizontal polarization antenna element 61 is formed with the sizes shown in FIGS. 6A and 6C.

As shown in FIG. 7A, the directivity in the horizontal plane of the horizontal polarization antenna element 61 was substantially uniform, and the deviation thereof was 2.53 dB (maximum 2.86 dBi, minimum 0.33 dBi). Besides, as shown in FIG. 7C, the bandwidth in which the VSWR is 1.5 or less is 50 MHz, and it is understood that the sufficient band can be achieved.

Figure 8A:
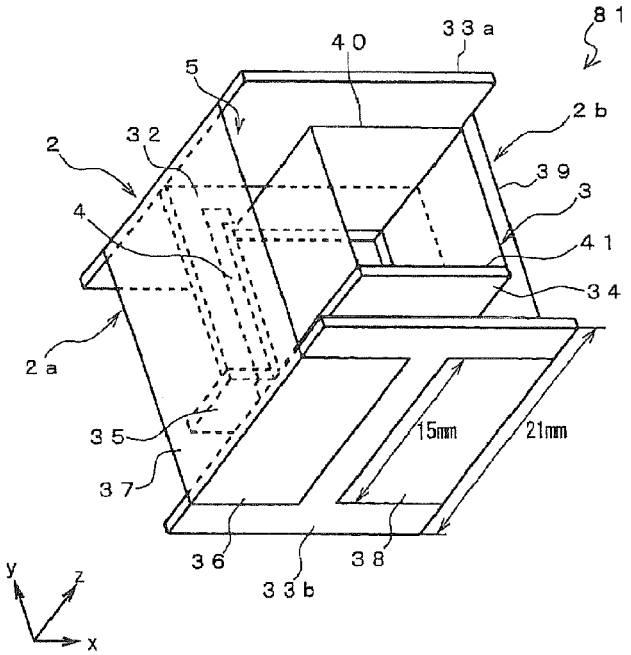
FIG. 8A is a perspective view showing a horizontal polarization antenna element of another embodiment of the invention.
Figure 8B:
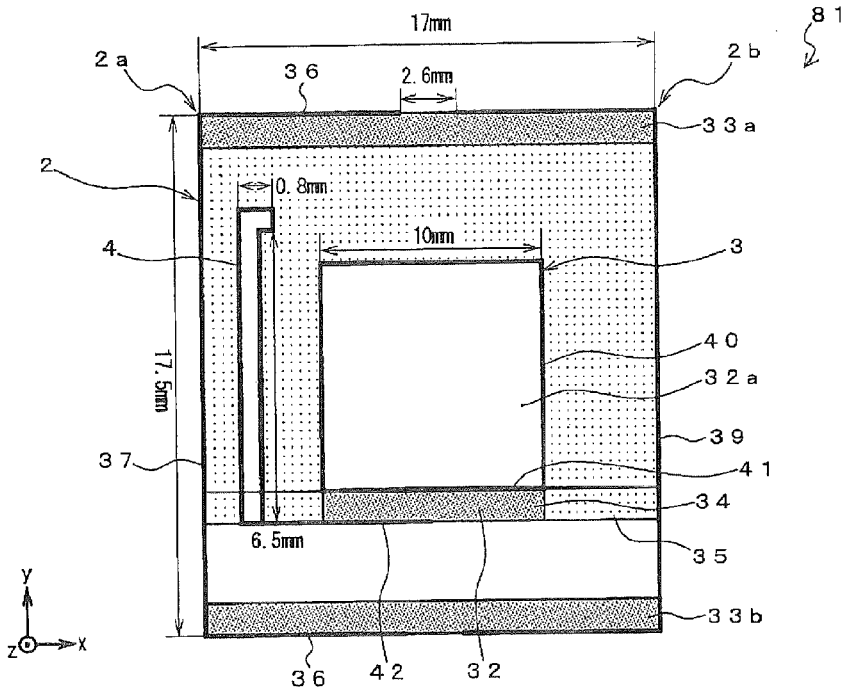
FIG. 8B is a top view thereof.

A horizontal polarization antenna element 81 shown in FIGS. 8A and 8B is such that in the horizontal polarization antenna element 61 of FIGS. 6A to 6C, the radiation conductor 2 and the vertical boards 33*a* and 33*b* are rotated clockwise by 90° in a top view, while the arrangement of the feeding element 4, the ground conductor 3, the horizontal board 32 and the ground board 34 is left the same. In the horizontal polarization antenna element 81, the vertical boards 33*a* and 33*b* are arranged so as to sandwich the horizontal board 32 from both sides in the Y-axis direction. However, the ground board 34 is fixed to one end (lower side in FIG. 8B) of the horizontal board 32 in the Y-axis direction, and the vertical board 33*b* cannot be fixed to the horizontal board 32. Thus, only the vertical board 33*a* is bonded and fixed to the horizontal board 32, and the horizontal board 32 is supported by the vertical board 33*b* through the metal plates 37 and 39.

Figure 9A:
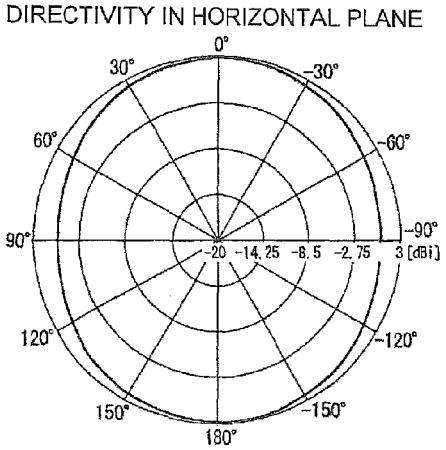
FIG. 9A illustrates a characteristic of directivity in the horizontal plane of the horizontal polarization antenna element of FIG. 8A and FIG. 8B.
Figure 9B:
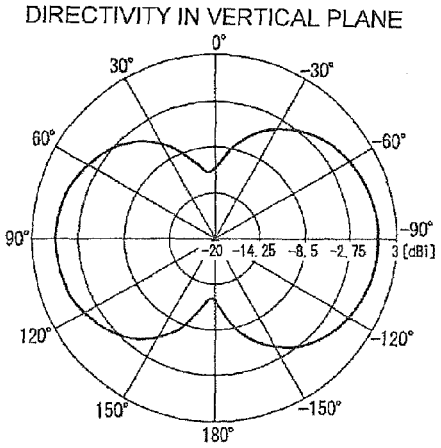
FIG. 9B illustrates a characteristic of directivity in the vertical plane thereof.
Figure 9C:
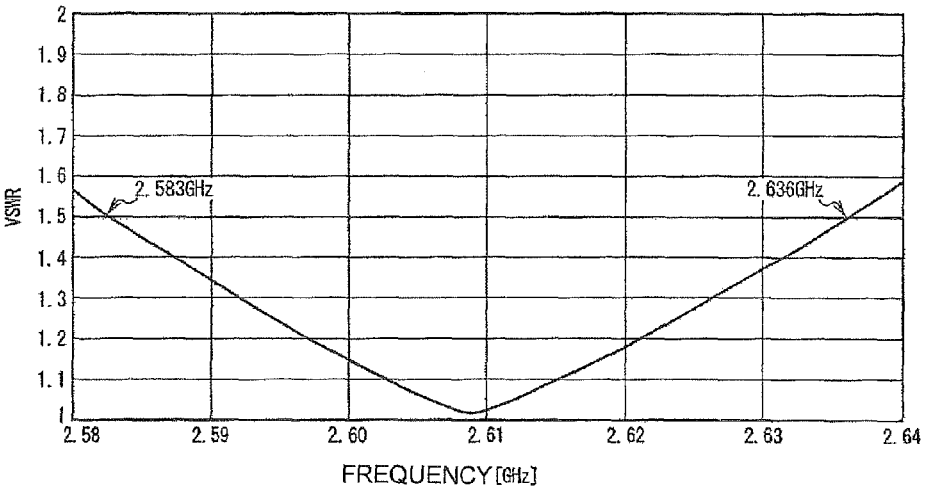
FIG. 9C illustrates a VSWR characteristic.

Sizes of respective parts when the center frequency $f_0$ is 2610 MHz are shown in FIGS. 8A and 8B. Incidentally, in order to cope with the change of the coupling state due to the rotation of the radiation conductor 2, as compared with the horizontal polarization antenna element 61 of FIGS. 6A to 6C, the length of the feeding element 4 and the interval between both the conductor plates 2*a* and 2*b* are suitably changed. FIGS. 9A to 9C show a directivity in the horizontal plane, a directivity in the vertical plane, and a VSWR characteristic when the horizontal polarization antenna element 81 is formed with the sizes of FIGS. 8A and 8B.

As shown in FIG. 9A, the directivity of the horizontal polarization antenna element 81 in the horizontal plane was substantially uniform, and the deviation thereof was 2.98 dB (maximum 2.84 dBi, minimum −0.14 dBi). As is understood from the comparison between FIG. 9A and FIG. 7A, when the radiation conductor 2 is rotated by 90° in a top view, the characteristic of the directivity in the horizontal plane also becomes the characteristic rotated by 90° in a top view. Besides, as shown in FIG. 9C, the bandwidth in which the VSWR of the horizontal polarization antenna element 81 is 1.5 or less is 53 MHz, and it is understood that the sufficient band can be achieved.

Figure 10:
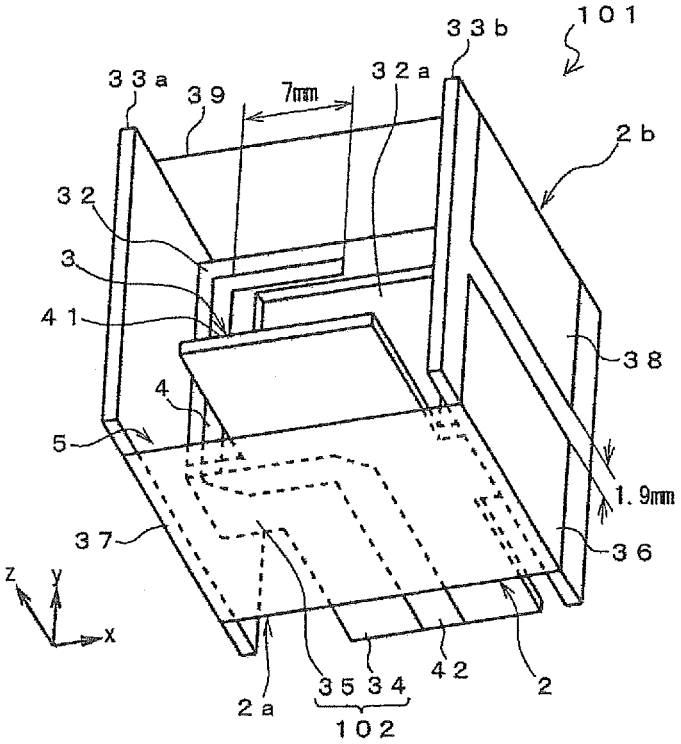
FIG. 10 is a perspective view showing a horizontal polarization antenna element of another embodiment.

A horizontal polarization antenna element 101 shown in FIG. 10 is such that in the horizontal polarization antenna element 61 of FIGS. 6A to 6C, the ground metal plate 40 is omitted. In the foregoing horizontal polarization antenna elements 1, 31, 61 and 81, the ground conductor 3 has the rectangular tube shape. However, the ground conductor 3 is not necessarily required to have the tube shape, and may be made only the ground conductor pattern 41 formed on the rear surface R of the ground board 34. Incidentally, in FIG. 10, although the notch 32*a* of the horizontal board 32 remains, the notch 32*a* may be omitted, and the horizontal board 32 can be made to have a rectangular shape. Besides, in the horizontal polarization antenna element 101, the ground board 34 and the fixing member 35 are integrally formed, and an integral board 102 formed in a cross shape in whole in a side view is used.

Figure 11A:
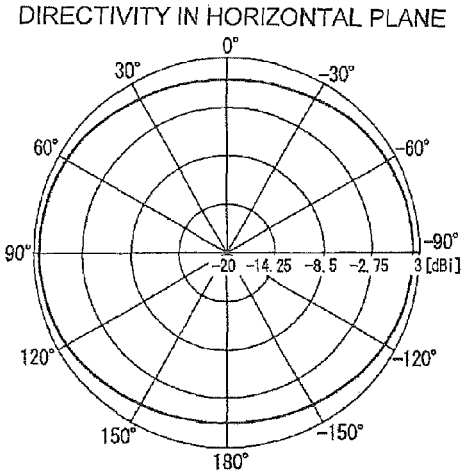
FIG. 11A illustrates a characteristic of directivity in the horizontal plane of the horizontal polarization antenna element of FIG. 10.
Figure 11B:
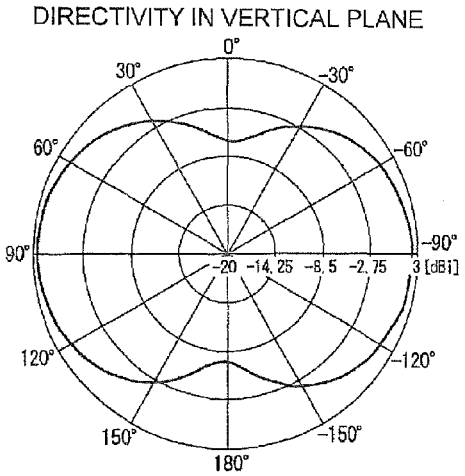
FIG. 11B illustrates a characteristic of directivity in the vertical plane thereof.
Figure 11C:
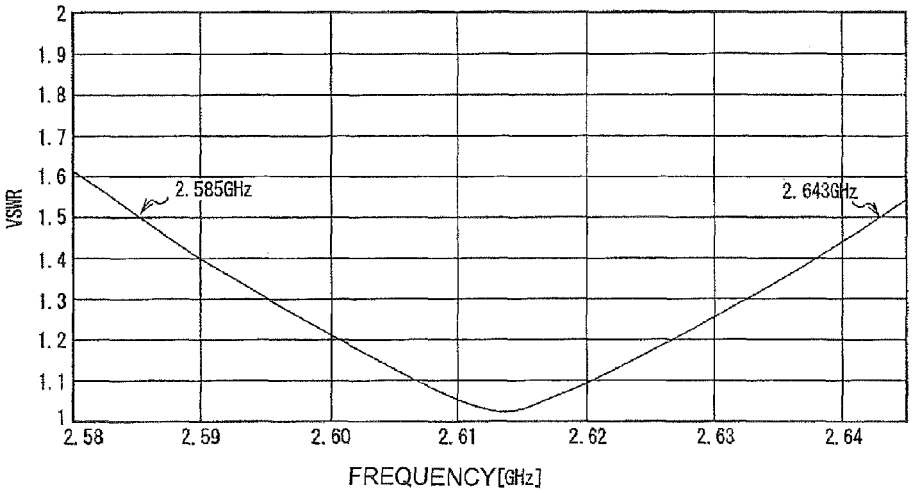
FIG. 11C is a view showing a VSWR characteristic.

FIGS. 11A to 11C show a directivity in the horizontal plane of the horizontal polarization antenna element 101, a directivity in the vertical plane and a VSWR characteristic.

As shown in FIG. 11A, the directivity in the horizontal plane of the horizontal polarization antenna element 101 was substantially uniform, and the deviation thereof was 2.5 dB (maximum 2.45 dBi, minimum −0.05 dBi). Besides, as shown in FIG. 11C, the bandwidth in which the VSWR of the horizontal polarization antenna element 101 is 1.5 or less is 58 MHz, and it is understood that the sufficient band can be achieved.

In the horizontal polarization antenna element 101, since the ground metal plate 40 is omitted, the number of parts is reduced and the cost can be reduced. Besides, as compared with the foregoing horizontal polarization antenna elements 1, 31, 61 and 81, the wide bandwidth can be achieved.

However, in the horizontal polarization antenna element 101, since the ground metal plate 40 is omitted, coupling to the periphery of the feeding element 4 becomes weak. Thus, in order to improve this, the feeding element 4 is made long, and the interval between both the conductor plates 2*a* and 2*b* is made small. In an antenna apparatus, a radome made of a dielectric material, such as FRP, is provided at the outermost part. However, if the radome is provided, the coupling state of the feeding element 4 to the periphery is changed, and for this adjustment, the feeding element 4 is generally made long. Like the horizontal polarization antenna element 101, if the feeding element 4 is made long, the adjustment when the radome is provided can become difficult. Thus, from the viewpoint that an adjustment margin for provision of the radome is left, it is desirable that the ground metal plate 40 is not omitted, and the feeding element 4 is set to be as small as possible.

Antenna Apparatus

Next, an antenna apparatus will be described.

An antenna apparatus of an embodiment includes at least one of the foregoing horizontal polarization antenna elements 1, 31, 61, 81 and 101. Here, an antenna apparatus in which the plural horizontal polarization antenna elements 1, 31, 61, 81 and 101 are arranged in an array shape in the vertical direction will be described.

Figure 12A:
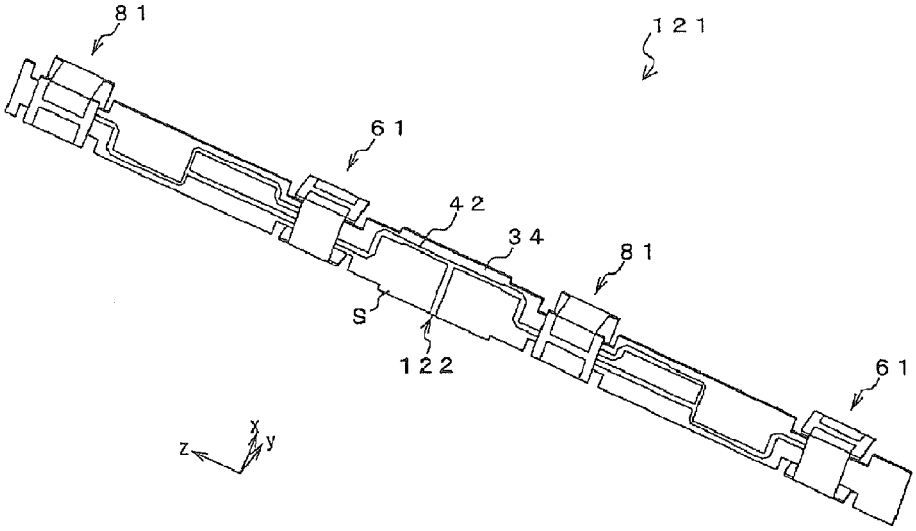
FIG. 12A and FIG. 12B are perspective views showing an antenna apparatus of an embodiment of the invention.
Figure 12B:
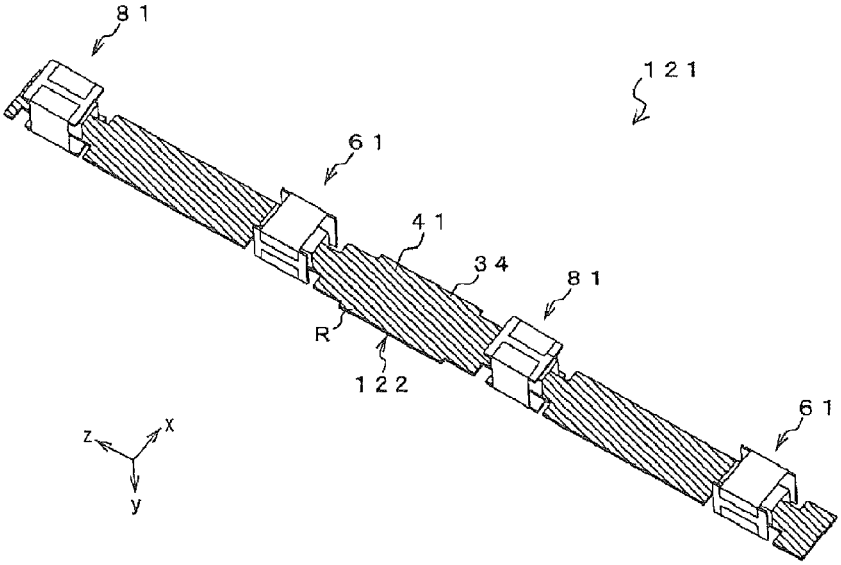

An antenna apparatus 121 shown in FIGS. 12A and 12B is a four-element array antenna which includes two horizontal polarization antenna elements 61 of FIGS. 6A to 6C and two horizontal polarization antenna elements 81 of FIGS. 8A and 8B and in which the horizontal polarization antenna elements 61 and 81 are alternately arranged in the vertical direction.

That is, the antenna apparatus 121 is such that two kinds of the horizontal polarization antenna elements 61 and 81 are formed in which the arrangement of the feeding element 4 and the ground conductor 3 is the same, and the radiation conductor 2 is relatively rotated by 90° in a top view, and both the horizontal polarization antenna elements 61 and 81 are alternately arranged.

The ground board 34 of the respective horizontal polarization antenna elements 61 and 81 is common. A ground conductor pattern 41 is formed on the whole surface of the rear surface R of the ground board 34, and a feeding line 42 is formed of a conductor pattern on the front surface S. In this embodiment, a feeding part 122 to which a feeder line such as a coaxial cable is connected is formed at the center of the ground board 34 in the vertical direction (Z-axis direction), and the feeding line 42 is formed so that the feeding line branches in a tournament shape from the feeding part 122, and feeds power to the respective horizontal polarization antenna elements 61 and 81.

Besides, in this embodiment, the lengths of the feeding line 42 from the feeding part 122 to the respective horizontal polarization antenna elements 61 and 81 are made equal to each other, and in-phase feeding is performed to the respective horizontal polarization antenna elements 61 and 81.

Figure 13:
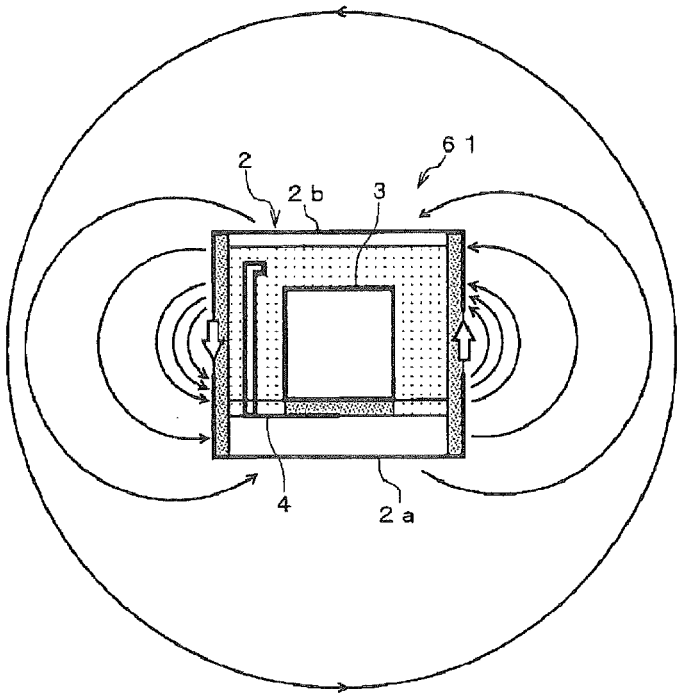
FIG. 13 illustrates an electric field distribution in the vicinity of the horizontal polarization antenna element of FIG. 6A to FIG. 6C.
Figure 14:
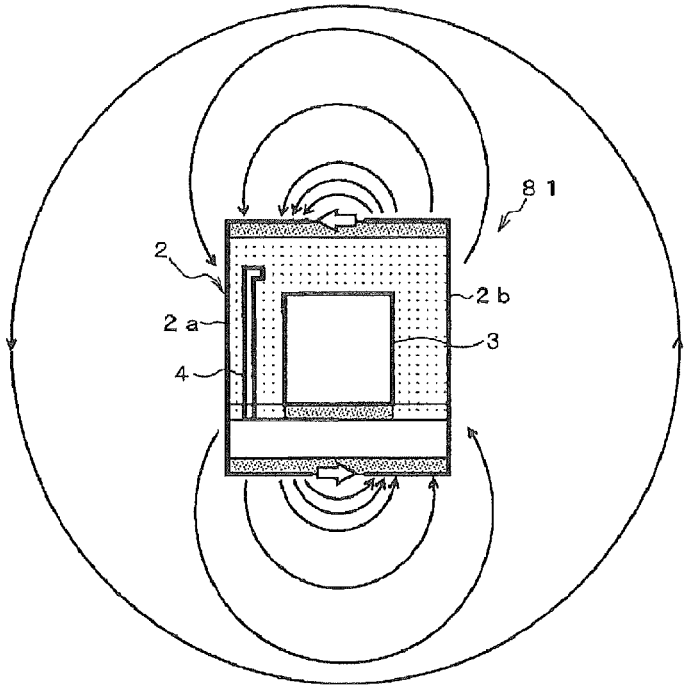
FIG. 14 illustrates an electric field distribution in the vicinity of the horizontal polarization antenna element of FIG. 8A and FIG. 8B when power is fed at the same phase as FIG. 13.

FIG. 13 and FIG. 14 are views showing electric field distributions in the vicinities of the horizontal polarization antenna elements 61 and 81 when in-phase feeding is performed to the horizontal polarization antenna elements 61 and 81. As shown in FIG. 13 and FIG. 14, when electrical power is fed to the feeding element 4, the conductor plates 2*a* and 2*b* are excited, high electric fields opposite in direction are generated in the gap between the conductor plates 2*a* and 2*b*, and the radiation conductor 2 behaves as if powers having opposite phases and the same amplitude are supplied to two gaps between the conductor plates 2*a* and 2*b*. As is understood from the comparison between FIG. 13 and FIG. 14, the direction of electric field when in-phase feeding is performed is the same in the horizontal polarization antenna elements 61 and 81, and it is understood that when in-phase feeding is performed to the horizontal polarization antenna elements 61 and 81, an effect of mutually intensifying the electric fields is obtained by an array effect.

Besides, as described above, the horizontal polarization antenna element 61 and the horizontal polarization antenna element 81 have the characteristics in which the directivity in the horizontal plane is rotated by about 90° in a top view (see FIG. 7A, FIG. 9A). Thus, the radiation characteristics are mutually complemented by alternately arranging the horizontal polarization antenna elements 61 and 81, and the directivity in the horizontal plane in the whole antenna apparatus 121 can be more uniformed.

Incidentally, for example, even when the horizontal polarization antenna element 61 rotated by 90° in a top view is used instead of the horizontal polarization antenna element 81, the same characteristic can be obtained. However, in this case, since the horizontal polarization antenna element 61 is required to be rotated, the feeding position cannot be formed on the same plane, the feeding line 42 is required to have a three-dimensional structure, and the structure becomes complicated. Thus, in order to simplify the structure, the directivity in the horizontal plane is preferably made more uniform by using the two kinds of the horizontal polarization antenna elements 61 and 81 in which the arrangement of the feeding element 4 and the ground conductor 3 is the same, the feeding position is on the same plane, and the radiation conductor 2 is relatively rotated by 90° in a top view.

The interval between the adjacent horizontal polarization antenna elements 61 and 81 is made about 0.8λ in which the directivity in the horizontal plane becomes most excellent. Incidentally, if only the air exists between the horizontal polarization antenna elements 61 and 81, 0.8λ is optimum. However, actually, the board (ground board 34) is inserted between the horizontal polarization antenna elements 61 and 81, and therefore, fine adjustment is required to be preformed in view of the influence of the dielectric constant. In the antenna apparatus 121 of FIGS. 12A and 12B, the whole length thereof in the vertical direction (Z-axis direction) is 320 mm.

Further, although not shown, in the antenna apparatus 121, a radome is provided so as to cover the horizontal polarization antenna elements 61 and 81 and the common ground board 34. As described above, since the radome is made a dielectric such as FRP, the radiation characteristic of the antenna apparatus 121 is slightly changed by providing the radome. Thus, in view of the provision of the radome, the sizes (length of the feeding element 4, interval between the conductor plates 2*a* and 2*b*) of the respective parts of the horizontal polarization antenna elements 61 and 81 are required to be adjusted in advance. Since the length of one side (length in the Z-axis direction, Y-axis direction) of each of the horizontal polarization antenna elements 61 and 81 is about 17 mm, if the tolerance is made small, the antenna elements and the like can be contained in the radome having an inner diameter of ϕ25 mm, and the thin-diameter antenna apparatus 121 can be achieved.

Figure 15A:
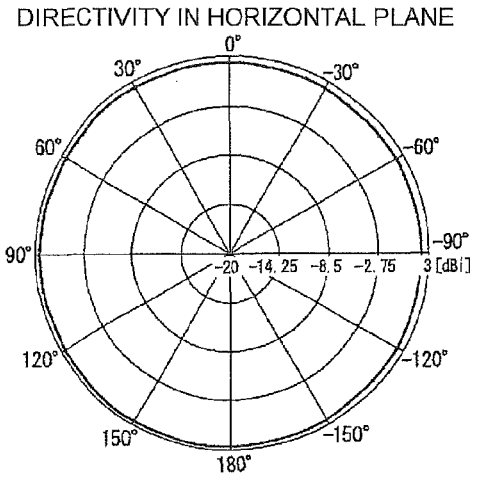
FIG. 15A illustrates a characteristic of directivity in the horizontal plane of the antenna apparatus of FIG. 12A and FIG. 12B.
Figure 15B:
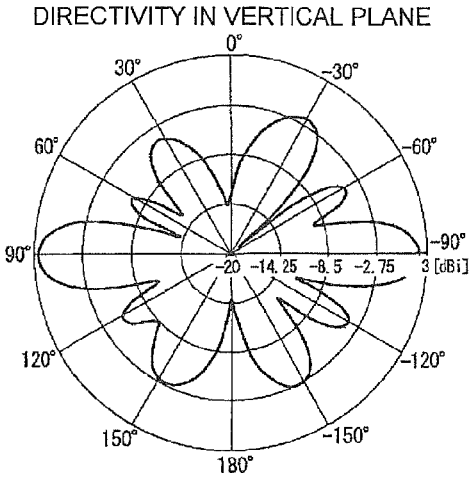
FIG. 15B illustrates a characteristic of directivity in the vertical plane thereof.

The directivity in the horizontal plane of the antenna apparatus 121 of FIGS. 12A and 12B and the directivity in the vertical plane are respectively shown in FIGS. 15A and 15B. As shown in FIG. 15A, the directivity in the horizontal plane of the antenna apparatus 121 was very uniform, and the deviation thereof was 0.58 dB (maximum 6.54 dBi, minimum 5.96 dBi). Since the smallest deviation of directivity in the horizontal plane achieved in the related art antenna apparatus is about 1 dB, it is understood that according to the antenna apparatus 121, a very high effect is obtained in the uniformity of the directivity in the horizontal plane.

Figure 16:
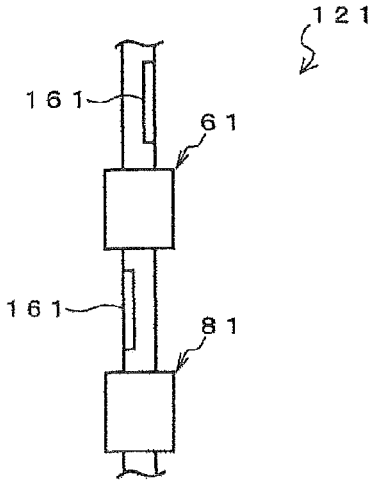
FIG. 16 is a side view showing an antenna apparatus of a modified embodiment of the invention.

Besides, as shown in FIG. 16, a vertical horizontal polarization antenna element 161 with uniform directivity in the horizontal plane is further provided, the vertical horizontal polarization antenna element 161 is arranged between the adjacent horizontal polarization antenna elements 61 and 81, and the vertical horizontal polarization antenna element 161 and the horizontal polarization antenna elements 61 and 81 are arranged in an array shape in the vertical direction, so that a polarization diversity omnidirectional antenna can be achieved.

As described above, the antenna apparatus of the invention is provided with the horizontal polarization antenna element including the radiation conductor 2 that includes the two conductor plates 2*a* and 2*b* subjected to bending work and arranged to be opposite to each other with a specific interval therebetween and has the tube shape extending in the vertical direction in whole, the ground conductor 3 that is arranged in the inner space surrounded by the two conductor plates 2*a* and 2*b* of the radiation conductor 2 and is electrically grounded, and the feeding element 4 that is arranged in the inner space 5, is arranged along the inner walls of the conductor plates 2*a* and 2*b* in a top view, operates as a reverse L antenna when electrical power is fed between one end thereof and the ground conductor 3, and feeds power to the radiation conductor 2 by electromagnetic coupling.

By the structure as stated above, the horizontal polarization antenna element can be achieved which has the uniform directivity in the horizontal plane and is compact like the related art, and the antenna apparatus can be achieved which has the sufficiently wide bandwidth and the uniform directivity in the horizontal plane. Besides, in the antenna apparatus, since the reverse L antenna as a modification of a monopole antenna is used as the feeding element 4, a balun is not required unlike a case where a dipole antenna is used, and the structure is simple.

More specifically, according to the invention, when the center frequency is 2610 MHz, the bandwidth in which VSWR is 1.5 or more can be made 49 MHz or more, and the deviation of the directivity in the horizontal plane can be made less than 3 dB. At this time, the horizontal polarization antenna element is compact such that the height thereof is 15 mm, and the length of one side of the radiation conductor 2 is about 17 mm. The antenna element can be contained in a radome having an inner diameter of 25 ϕmm, and the thin-diameter antenna apparatus can be achieved.

Besides, in the antenna apparatus of the invention, the matching of the impedance and the adjustment of the center frequency can be performed by the length of the feeding element 4 and the interval (or overlap length) between the conductors 2*a* and 2*b*, and the matching of the impedance and the adjustment of the center frequency are easy.

Further, since the ground conductor 3 is arranged at the center of the inner space 5 in a top view is formed in the tube shape extending in the vertical direction, coupling to the periphery of the feeding element 4 is intensified, the feeding element 4 can be made short, and the adjustment margin when the radome is provided can be sufficiently left.

Further, since the two conductor plates 2*a* and 2*b* are formed in the U shape in a top view, and the openings thereof are made opposite to each other, the horizontal polarization antenna element can be simply constructed by using the board formed with the conductor pattern and the metal plate.

Besides, the two kinds of the horizontal polarization antenna elements are formed in which the arrangement of the feeding element 4 and the ground conductor 3 is the same, and the radiation conductor 2 is relatively rotated by 90° in a top view, and both the horizontal polarization antenna elements are alternately arranged. Thus, the deviation of the directivity in the horizontal plane can be made as very small as 0.58 dB.

The invention is not limited to the above embodiments and can be naturally modified within the scope not departing from the gist of the invention.

Figure 17:
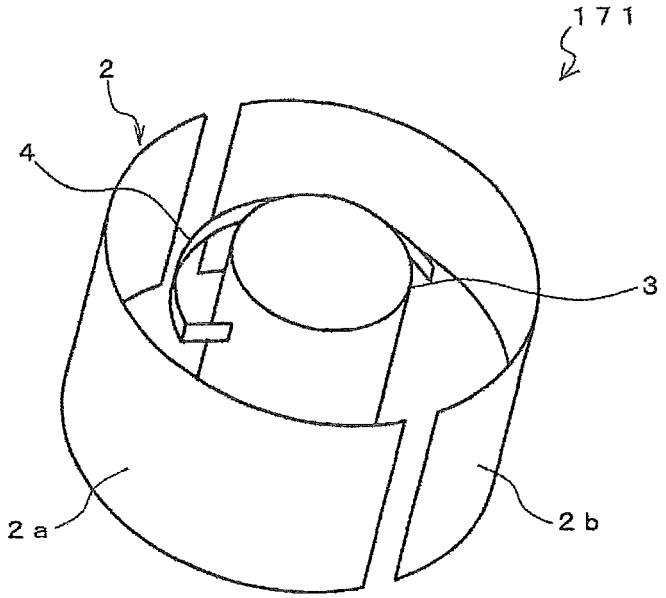
FIG. 17 is a perspective view showing a horizontal polarization antenna element of a modified embodiment used in an antenna apparatus of the invention.

For example, in the above embodiments, although the two conductor plates 2*a* and 2*b* are formed in the U shape in a top view, no limitation is made to this, and the corner thereof may be rounded so that the conductor plates are easily contained in the radome. Further, like a horizontal polarization antenna element 171 shown in FIG. 17, two conductor plates 2*a* and 2*b* are formed in an arc shape in a top view, and may be arranged so that the openings thereof are opposite to each other. FIG. 17 shows a case where both the conductor plates 2*a* and 2*b* are formed in a semicircular shape in a top view, and a radiation conductor 2 having a cylindrical shape in whole is formed. In this case, a feeding element 4 is formed in an arc shape along the inner walls of the conductor plates 2*a* and 2*b*. Incidentally, a ground conductor 3 is also desirably formed in a cylindrical shape in accordance with the shape of the radiation conductor 2.

Besides, in the above embodiments, although the description is made on the case where the horizontal polarization antenna element is formed by bonding and fixing or soldering and fixing the separately formed boards 32, 33*a*, 33*b* and 34 and the metal plates 37 and 39, these may be integrally formed by insert molding. Further, for example, the whole antenna apparatus 121 shown in FIGS. 12A and 12B (that is, the plural horizontal polarization antenna elements and the common ground board 34) can be integrally formed by insert molding.

Further, in the above embodiments, although the description is made on the case where the conductor pattern 36, 38 and the metal plate 37, 39, and the ground conductor pattern 41 and the ground metal plate 40 are fixed by soldering, no limitation is made to this. For example, a locking structure including a groove, a projection and the like is provided, and both are locked and brought into contact to each other to achieve electrical connection. However, if the high frequency (2610 MHz) is used as in the above embodiments, soldering with high reliability is desirable.

Figure 18:
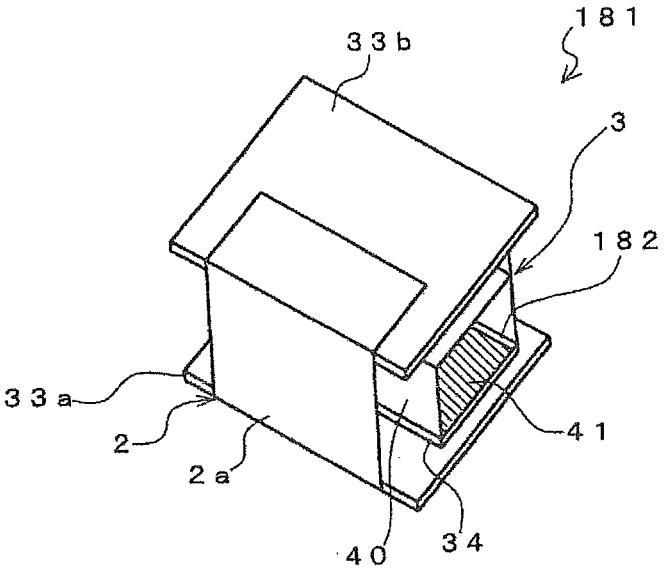
FIG. 18 is a perspective view showing a horizontal polarization antenna element of a modified embodiment used in an antenna apparatus of the invention.

Besides, in the above embodiments, the description is made on the case where the ground conductor 3 is formed by soldering and directly electrically connecting both the ends of the ground metal plate 40 formed in the U shape in a top view and both the ends of the ground conductor pattern 41 formed on the rear surface R of the ground board 34. However, no limitation is made to this, and like a horizontal polarization antenna element 181 shown in FIG. 18, a gap (slit) 182 may be formed between both ends of a ground conductor pattern 41 and both ends of a ground metal plate 40. FIG. 18 shows a case where the gap 182 is formed in the horizontal polarization antenna element 31 of FIGS. 3A to 3C.

When the gap 182 is formed, a portion which becomes the gap 182 and in which the ground conductor pattern 41 is not formed is formed at both sides of the ground board 34, and both ends of the ground metal plate 40 is bonded and fixed to the ground board 34. Incidentally, when both the ends of the ground metal plate 40 are bent inward and are bonded and fixed, the bonding strength can be enhanced. However, the width in which both the ends of the ground metal plate 40 are bent inward is required to be smaller than the width of the portion where the ground conductor pattern 41 is not formed.

When the gap 182 is formed between both the ends of the ground conductor pattern 41 and both the ends of the ground metal plate 40, an electric field is concentrated on the gap 182, coupling to the periphery of the feeding element 4 can be enhanced, and the length of the feeding element 4 can be shortened.

Figure 19:
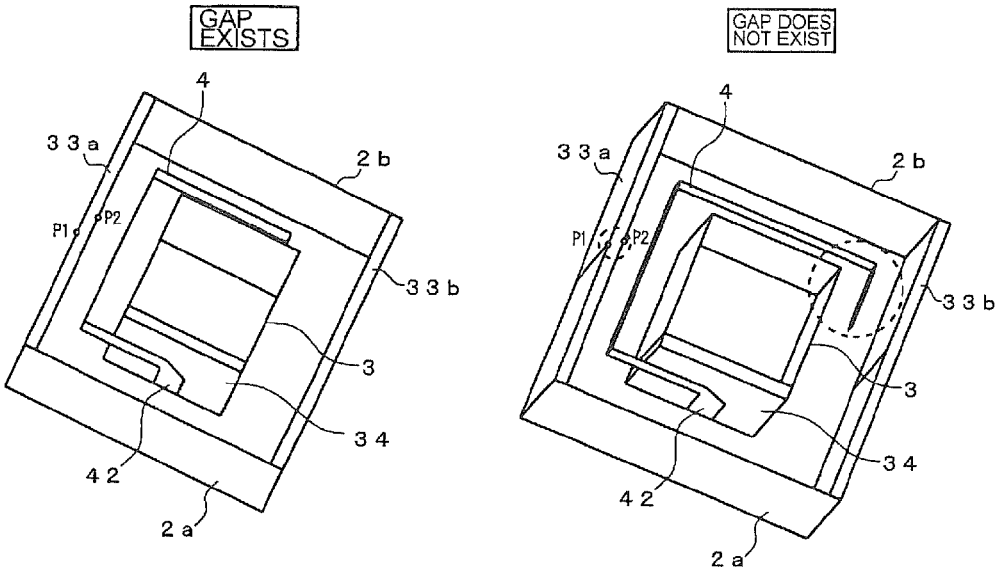
FIG. 19 is a view for explaining the operation of the horizontal polarization antenna element of FIG. 18.
Figure 20A:
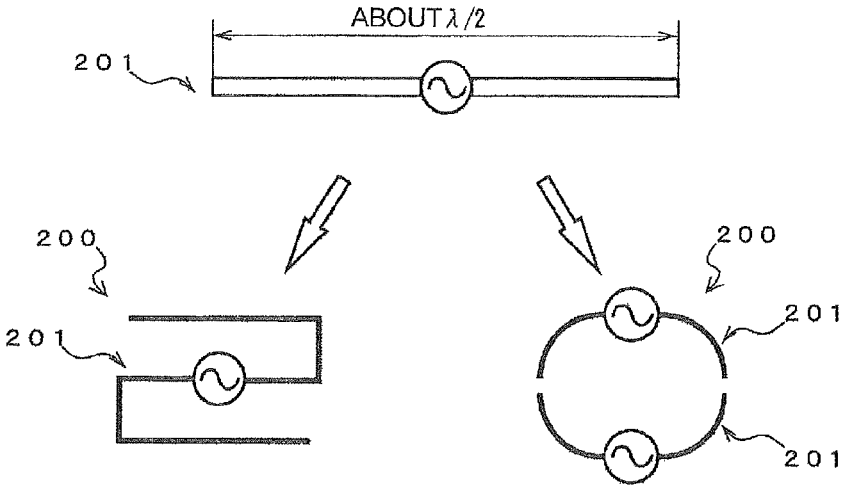
FIGS. 20A and 20B illustrate horizontal polarization antenna elements used in related art antenna apparatuses.
Figure 20B:
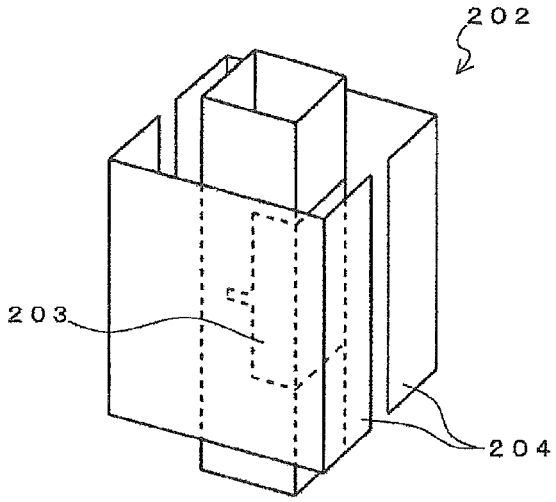

In the horizontal polarization antenna element 181 of FIG. 18, the horizontal board 32 was omitted, and a simulation was performed on the length of the feeding element 4 and the gap between the conductors 2*a* and 2*b* when the gap 182 existed and when the gap did not exist. FIG. 19 shows the simulation result. P1 in FIG. 19 denotes the position of a tip (side end) of the conductor plate 2*a*, and P2 denotes the position of a tip (side end) of the conductor plate 2*b*. Incidentally, the horizontal board 2 was omitted in order to enhance the influence due to the gap 182 and to facilitate understanding. The center frequency $f_0$ was made 2610 MHz similarly to the foregoing embodiments.

As shown in FIG. 19, when the gap 182 does not exist, the feeding element 4 becomes very long, and the interval between the conductor plates 2*a* and 2*b* is very narrow. Thus, there is a fear that an adjustment margin for provision of a radome is insufficient, and the adjustment of the center frequency $f_0$ becomes difficult. On the other hand, when the gap 182 exists, the feeding element 4 can be made relatively short, and the gap between the conductor plates 2*a* and 2*b* can be made relatively wide.

Although the invention has been described with respect to specific exemplary embodiments for complete and clear disclosure, the appended claims are not to be thus limited but are to be construed as embodying all modifications and alternative constructions that may occur to one skilled in the art which fairly fall within the basic teaching herein set forth.

Further, it is noted that Applicant's intent is to encompass equivalents of all claim elements, even if amended later during prosecution.

What is claimed is:

1. An antenna apparatus comprising a horizontal polarization antenna element, wherein the horizontal polarization antenna element includes:

a radiation conductor including two conductor plates subjected to bending work and arranged to be opposite to each other with a specific interval therebetween, the radiation conductor having a tube shape extending in a vertical direction in whole;

a ground conductor arranged in an inner space surrounded by the two conductor plates of the radiation conductor, the ground conductor being electrically grounded; and a feeding element arranged in the inner space to be along inner walls of the conductor plates in a top view, the feeding element operating as a reverse L antenna when electrical power is fed between one end thereof and the ground conductor, and feeding power to the radiation conductor by electromagnetic coupling, wherein each of the two conductor plates has a U shape in a top view, and openings of the conductor plates are arranged opposite to each other, wherein the horizontal polarization antenna element further includes a horizontal board arranged on a horizontal plane, and two vertical boards arranged to be opposite to each other across the horizontal board and to extend in the vertical direction while front surfaces are directed outward, one of the conductor plates includes conductor patterns formed on front surface sides and at one side ends of both the vertical boards, and a metal plate electrically connected to both the conductor patterns and provided to extend between the one side ends of both the vertical boards, the other of the conductor plates includes conductor patterns formed on rear surface sides and at the other side ends of both the vertical boards, and a metal plate electrically connected to both the conductor patterns and provided to extend between the other side ends of both the vertical boards, and the feeding element includes a conductor pattern formed on the horizontal board.

2. The antenna apparatus according to claim 1, wherein the ground conductor has a tube shape extending in the vertical direction and is arranged at a center of the inner space in a top view, and the feeding element is arranged in the inner space between the conductor plate and the ground conductor.

3. The antenna apparatus according to claim 1, wherein the horizontal board has a concave shape in a top view, the horizontal polarization antenna element further includes a ground board provided to close an opening of the horizontal board and extending in the vertical direction while a front surface is directed outward, the ground conductor includes a ground conductor pattern formed on a rear surface of the ground board, a ground metal plate contained in a concave-shaped cut-away part of the horizontal board and having a U shape with an opening directed to the ground board side in a top view, and the ground conductor pattern and the ground metal plate provide a gap between both ends of the ground conductor pattern and both ends of the ground metal plate.

4. The antenna apparatus according to claim 1, wherein side ends of the two conductor plates in a horizontal direction overlap each other.

5. The antenna apparatus according to claim 1, wherein each of the two conductors has an arc shape in a top view, and the openings of the conductor plates are arranged opposite to each other.

6. The antenna apparatus according to claim 1, wherein the horizontal polarization antenna element is arrayed in the vertical direction.

7. The antenna apparatus according to claim 6, wherein two kinds of the horizontal polarization antenna elements are provided in which an arrangement of the feeding element and the ground conductor is same, and the radiation conductor is relatively rotated by 90□ in a top view, and the horizontal polarization antenna elements are alternately arranged.

8. The antenna apparatus according to claim 6, further comprising a vertical polarization antenna element, wherein the vertical polarization antenna element and the horizontal polarization antenna element are arrayed in the vertical direction.

9. An antenna apparatus comprising a horizontal polarization antenna element, wherein the horizontal polarization antenna element includes:

a radiation conductor including two conductor plates subjected to bending work and arranged to be opposite to each other with a specific interval therebetween, the radiation conductor having a tube shape extending in a vertical direction in whole;

a ground conductor arranged in an inner space surrounded by the two conductor plates of the radiation conductor, the ground conductor being electrically grounded; and a feeding element arranged in the inner space to be along inner walls of the conductor plates in a top view, the feeding element operating as a reverse L antenna when electrical power is fed between one end thereof and the ground conductor, and feeding power to the radiation conductor by electromagnetic coupling, wherein each of the two conductor plates has a U shape in a top view, and openings of the conductor plates are arranged opposite to each other, wherein the horizontal polarization antenna element further includes a horizontal board arranged on a horizontal plane, and two vertical boards arranged to be opposite to each other across the horizontal board and to extend in the vertical direction while front surfaces are directed outward, one of the conductor plates includes conductor patterns formed on front surface sides and at one side ends of both the vertical boards, and a metal plate electrically connected to both the conductor patterns and provided to extend between the one side ends of both the vertical boards, the other of the conductor plates includes conductor patterns formed on the front surface sides and at the other side ends of both the vertical boards, and a metal plate electrically connected to both the conductor patterns and provided to extend between the other side ends of both the vertical boards, and the feeding element includes a conductor pattern formed on the horizontal board.

* * * * *